United States Patent [19]

Villalobos

[11] Patent Number: 4,757,619

[45] Date of Patent: Jul. 19, 1988

[54] SUCTION TRANSFER SYSTEM FOR HIGH SPEED PAPER DRYER

[75] Inventor: Joseph A. Villalobos, Mahwah, N.J.

[73] Assignee: Thermo Electron Web Systems, Inc., Auburn, Mass.

[21] Appl. No.: 918,593

[22] Filed: Oct. 10, 1986

Related U.S. Application Data

[63] Continuation of Ser. No. 732,936, May 13, 1985, abandoned.

[51] Int. Cl.[4] ..... F26B 13/10

[52] U.S. Cl. ..... 34/116; 34/123; 162/363

[58] Field of Search ..... 34/113, 114, 116, 117, 34/123; 162/206, 290, 306, 359, 363

[56] References Cited

U.S. PATENT DOCUMENTS

| | | | |
|---|---|---|---|
| 3,395,458 | 8/1968 | Whittaker et al. | 34/114 |
| 3,708,390 | 1/1973 | Krake | 162/363 |
| 4,359,828 | 11/1982 | Thomas | 34/114 |
| 4,441,263 | 4/1984 | Vedenpaa | 34/115 |
| 4,551,203 | 11/1985 | Eskelinen | 34/114 |
| 4,698,918 | 10/1987 | Kotitschke et al. | 34/116 |

*Primary Examiner*—David L. Lacey
*Assistant Examiner*—Andrew J. Anderson
*Attorney, Agent, or Firm*—Shenier & O'Connor

[57] ABSTRACT

A suction transfer device located over a length of a single continuous dryer fabric extending between two rolls and below which length the web to be dried extends, with the device producing preferential negative pressure in active sections at the edges of the fabric with relation to a relatively inactive central section between said active sections.

3 Claims, 4 Drawing Sheets

SUCTION TRANSFER SYSTEM FOR HIGH SPEED PAPER DRYER

This is a continuation of co-pending application Ser. No. 732,936 filed on May 13, 1985, now abandoned.

FIELD OF THE INVENTION

The invention relates to the field of high speed paper machine dryers and, more specifically, to a suction transfer system for such a high speed paper dryer.

BACKGROUND OF THE INVENTION

In conventional paper dryers of the prior art an upper felt is guided around the upper dryer rolls by a felt roll and a lower felt is guided around the lower dryer rolls by another felt roll. In the course of the drying operation the paper is sandwiched between the felts and the dryer rolls but is unsupported in the region in which it passes from a lower dryer roll to an upper dryer roll and vice versa. While such a machine provides a most efficient drying operation it is not capable of as high speed operation as is desirable owing to the presence of the "draws" or regions in which the paper web is unsupported as it passes between the upper and lower dryer rolls.

In order to afford a higher speed operation than is possible with a conventional dryer, there has been developed what is known as "unifelt" or "serpentine" dryer units in which a single endless felt is trained around upper and lower dryer rolls and associated guide rolls. Dryer sections of this type are capable of operating at speeds in excess of 2,000 feet a minute. A number of such sections are arranged immediately following the discharge of the press section of the paper machine after which the paper web has acquired sufficient strength to permit a return to the conventional dryer system.

The serpentine or unifelt run dryer has the advantage of being capable of operating at higher speeds at the wet end of the machine than does the conventional dryer for that the former supports the web over substantially its entire length. While this is true it does not provide as efficient a drying as does a conventional dryer.

In use of the serpentine dryer unit, the paper web is dropped from the last press roll to a suction roll and then it is transferred to the first bottom dryer. In the transfer region between the press and the first dryer the paper web runs outside of and below the felt. In this transfer section, which is approximately 5 to 10 feet long, the paper web, which could be about 300 inches wide, tends to delaminate from the fabric and begins to droop. This phenomenon is most pronounced at the edges of the section. As a result of this drooping, when the paper web hits the dryer section it gets crushed or folded over, thus forming a defect. As the speed increases the whole sheet begins to delaminate, wrinkles form, and breaks occur.

SUMMARY OF THE INVENTION

One object of my invention is to provide a suction transfer device which overcomes a problem existing in serpentine dryer sections of the prior art.

Another object of my invention is to provide a suction transfer device which is especially adapted for use in high speed drying operations.

Yet another object of my invention is to provide a suction transfer device which substantially reduces the possibility of defects in high speed paper drying operations.

A still further object of my invention is to provide a suction transfer device which is readily adapted to use with existing high speed dryers.

Other and further objects of my invention will appear from the following description.

BRIEF DESCRIPTION OF THE DRAWINGS

In the accompanying drawings to which reference is made in the instant specifications and which are to be read in conjunction therewith, and in which like reference numerals are used to indicate like characters in the various views:

FIG. 3 is a side elevation of my suction transfer device in use on the dryer illustrated in FIG. 1.

DESCRIPTION OF THE PREFERRED EMBODIMENT

Figure 1:
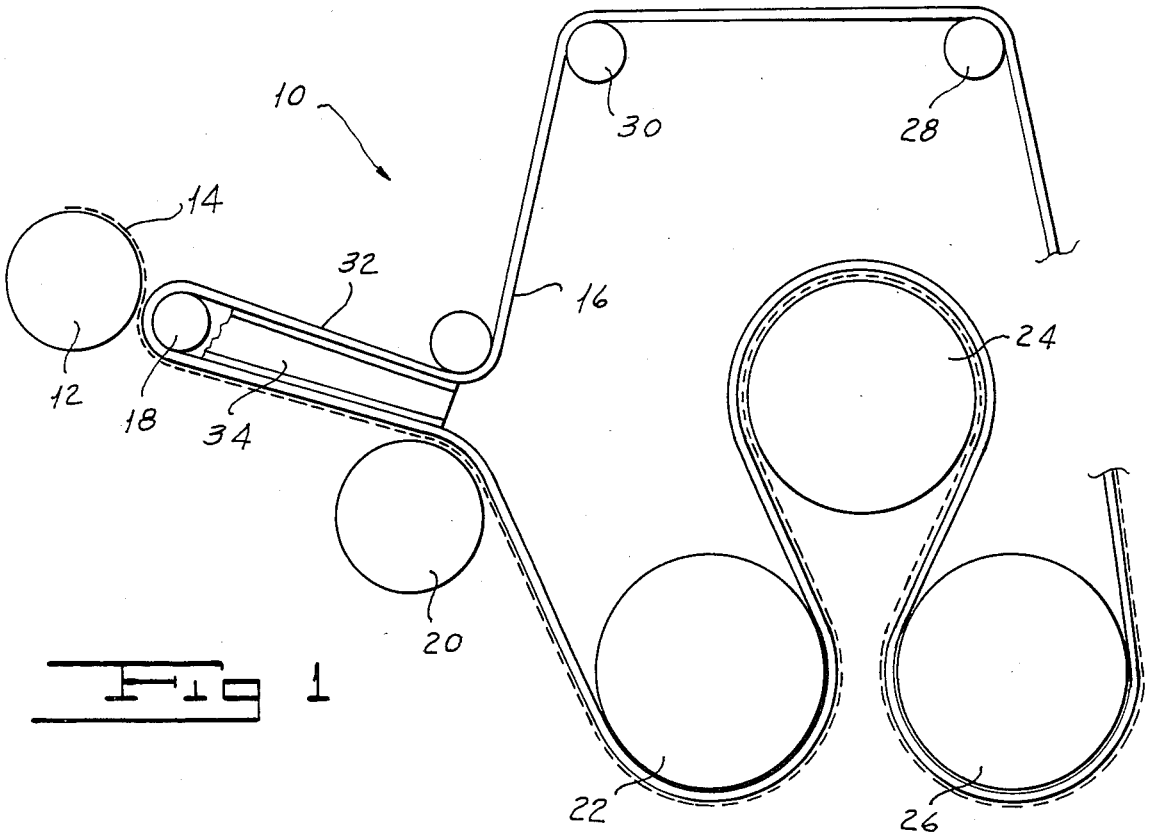
FIG. 1 is a partially schematic view of a high speed dryer provided with my suction transfer device.

Referring now to FIG. 1, a dryer section of the serpentine or unifelt type with which my suction transfer device is especially adapted to be used is indicated generally by the reference character 10. The unit 10 is adapted to receive a paper web 14 from the last press roll 12 at the wet end of the web forming section of the paper machine. The paper web is received by the dryer unit fabric or felt 16 in the region of a suction roll 18. From the suction roll 18 the fabric 16 passes to a baby dryer 20 and then around the first bottom dryer 22 from which it extends around the first top dryer 24 and then around the second bottom dryer 26. Upper return rolls 28 and 30 and a lower return roll 32 guide the fabric 16 back to the suction roll 18. By way of illustration I have shown the fabric 16 as a double line in FIG. 1 and have shown the paper web 14 as a broken line. It will readily be appreciated that there are as many dryer sections following that illustrated as are necessary to effect complete drying of the web.

As can be seen from FIG. 1 and has been pointed out hereinabove over the distance from the suction roll 18 to the baby dryer 20, the paper web 14 is outside of and below the felt 16. At this point the paper begins to delaminate from the fabric, the problem being particularly severe in the case of "fine papers" such as writing papers which are light in weight and which are very full in the sense that they have very little porosity. Such papers are very weak when they come out of the press section of the machine. My suction transfer device indicated generally by the reference character 34 which is disposed just above the felt 16 in the transfer region between the suction roll 18 and the baby dryer 20 overcomes the problem pointed out hereinabove in connection with high speed operation of the dryer.

Figure 2:
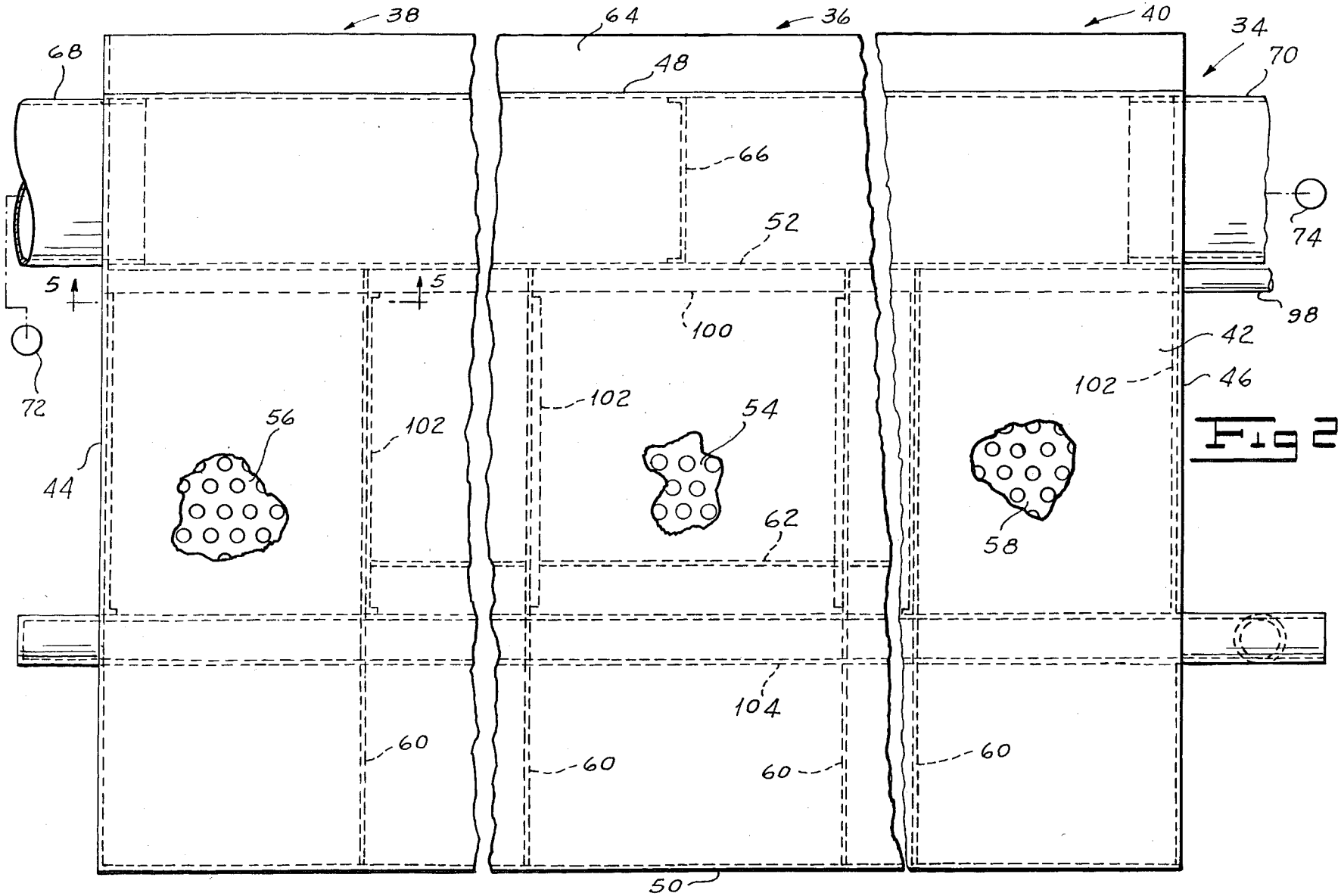
FIG. 2 is a top plan of my suction transfer device.
Figure 1:
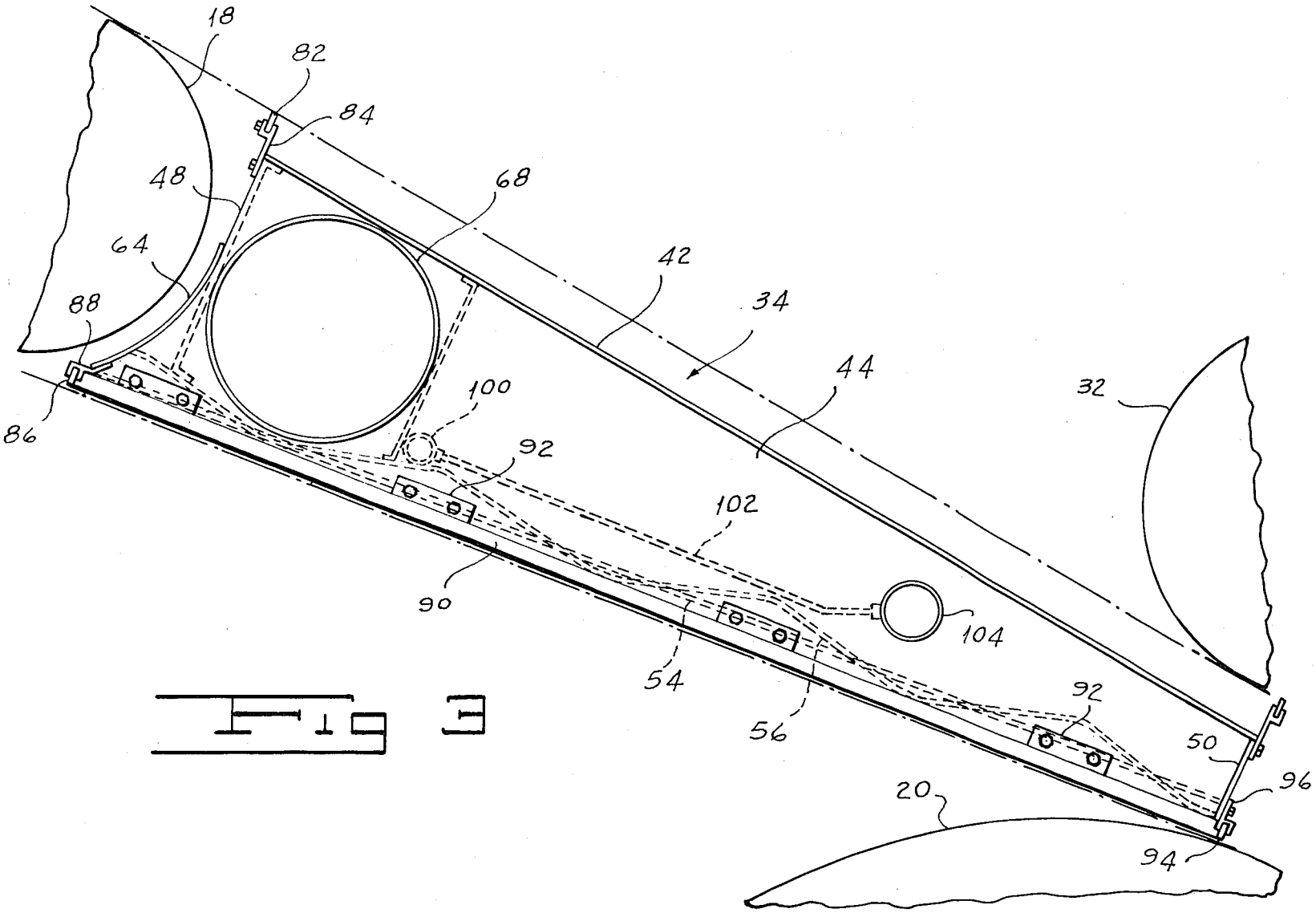

Referring now to FIGS. 2 and 3 of the drawings, my suction transfer device 34 is divided into a center section 36 and side sections 38 and 40. A top plate 42 common to all of the sections extends between respective side wall 44 and 46. Respective front and back walls 48 and 50 extend across the front and back of the unit 34. I dispose a transverse partition 52 across the unit slightly spaced behind the front wall 48. A center section bottom wall 54 closes the bottom of the center section while respective end section bottom walls 56 and 58 close the bottoms of the end sections. I provide the unit 34 with a plurality of stiffeners 60 spaced across the unit. A rear brace 62 extending across the device adds to its rigidity. It is to be understood that I form the entire structure of the device 34 so as to provide a high degree of rigidity, much in the manner of an aircraft wing. It will be appreciated that the device spans 300 or more inches and deflection should be minimized so that there will be close contact with the felt 16 at all points. I mount a blank 66 in the center of the space between wall 48 and the partition 52 to divide the space into two suction chambers from which respective ducts 68 and 70 lead. Individual exhaust fans 72 and 74 may be employed. It will readily be appreciated, of course, that any other suitable system may be provided for drawing air from the ducts 68 and 70.

Figure 4:
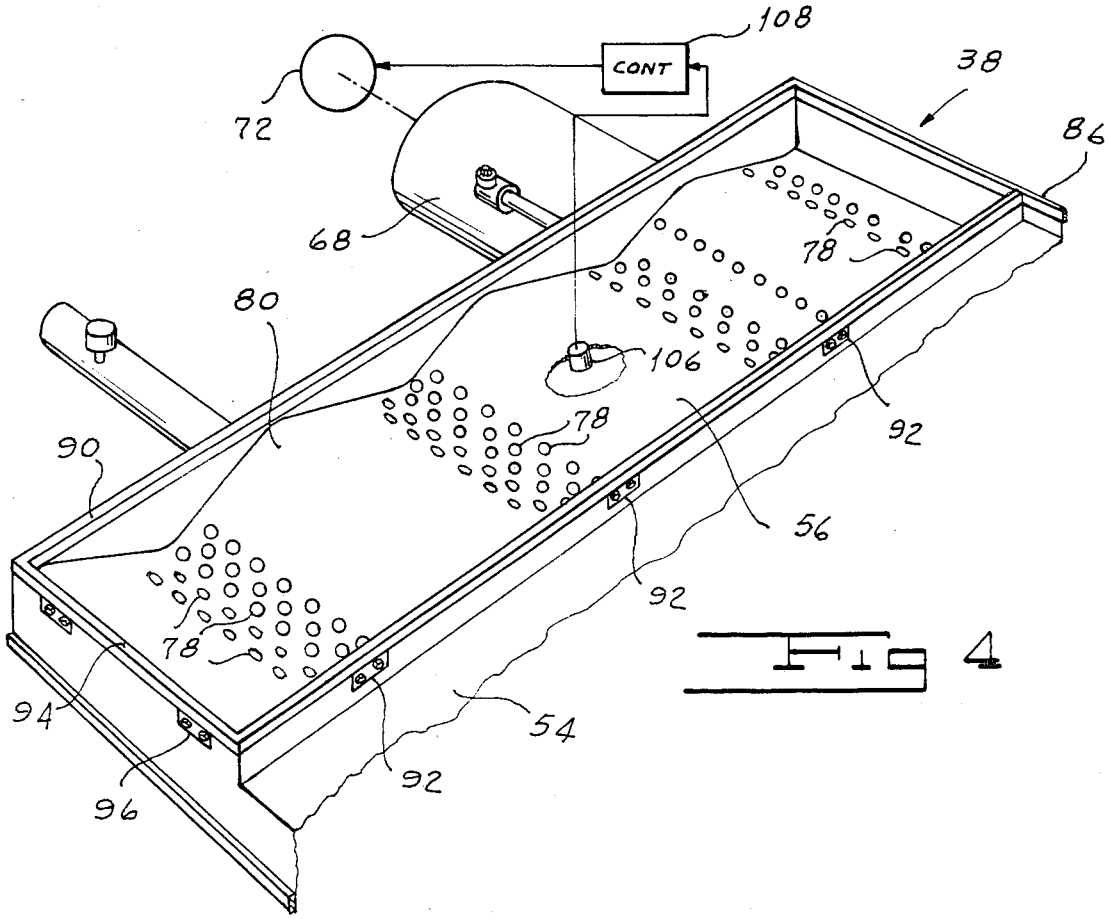
FIG. 4 is a fragmentary perspective view of a portion of my suction transfer device viewed from the under side thereof.
Figure 5:
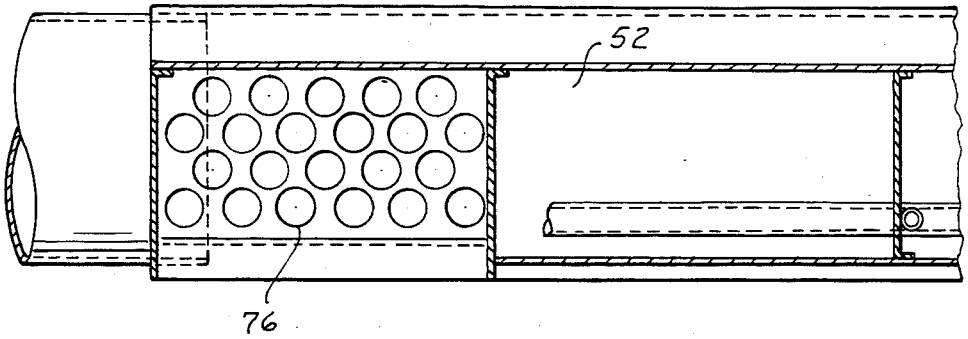
FIG. 5 is a fragmentary of my suction transfer unit taken along the line 5—5 of FIG. 2.

As can best be seen by reference to FIG. 5, we provide the portion of the partition 52 associated with each of the side sections 38 and 40 with a plurality of perforations 76 through which air can be drawn. Further, as can best be seen by reference to FIGS. 2 and 4, we provide the bottom walls 56 and 58 with a plurality of groups of perforations 78 through which air can be drawn from below the unit 34 into the side sections 38 and 34 and thence outwardly through the ducts 68 and 70. It is to be noted that further, we provide each of the side section bottom walls with a plurality of undulations 80 extending in a direction across the felt 16. The groups of perforations 78 are at the crests of the undulations 80 as viewed from above.

I provide the device 34 with a first or upper seal 82 extending across the entire width of the felt at a location at which it returns to the roll 18. A bracket 84 adjustably mounts the seal 82 on the front wall 48. A second seal 86 extending across the entire width of the felt 16 at a location at which it leaves the roll 18 is carried by a bracket 88 which adjustably secures the seal on the assembly 34. I provide each of the side sections 38 and 40 with respective edge seals 90 extending in the direction of movement of the web 16. Brackets 92 adjustably mount the seals 90 on the unit 34. Each of the side sections 38 and 40 also is provided with an end edge seal 94 carried by a bracket 96 which adjustably supports the seal on the unit.

From the description just given it will be seen that the entire periphery of each of the side sections 38 and 40 below the associated bottom plates 56 and 58 is sealed to the surface of the felt 16. Preferably the seals 82, 86, 90 and 94 do not contact the felt but leave a gap of ⅛ inch, for example, between the edge of the seal and the felt.

Moreover, while the entry to the center section below plate 54 is sealed by the seal 86, the exit of the center section below plate 54 and between seals 94 is open. Thus, the two side sections 36 and 38 are what might be termed "active" sections relative to the center section. These two side sections are approximately 18 inches wide. It has been found that in the usual installation a negative pressure of between about ¼ to ½ static pressure $H_2O$ column is satisfactory for each of the side sections.

It is to be noted that the groups of perforations 78 in the bottom walls 56 and 58 are located in crests of the undulations 80 as viewed from the top of the device. This arrangement ensures that the negative pressure is distributed as evenly as possible over these active side sections. These undulations diffuse the suction pressure since the velocity through the perforations 78 can be fairly high and a preferential effect in the area of the perforations is undesirable. The undulations 80 also provide additional structural strength at points where maximum stresses will be found. It will be appreciated of course that flat perforated plates could be used in place of the undulating plates.

As can be seen from FIGS. 3 and 4, the bottom plate 54 of the center section diverges outwardly from the plane of the felt 16 going from the entrance to the exit of the device 34. This plate causes the felt to develop a very slight negative pressure below the plate as a result of its velocity in travelling past the plate. That is to say, as the air is carried downwardly with the felt to a larger area it expands so as to develop a very slight negative pressure. This pressure is of the order of 1/100th of an inch of water of negative pressure. While it is very small, it is sufficient to keep "pucker-like" wrinkles out of the web. Preferably the center bottom plate 54 is at least partially perforated with the space thereabove connected to a source of negative pressure.

It will readily be appreciated that the device 34 is located outside of the dryer hood. Owing to the fact that there may be a great deal of moisture in the region of the device the possibility exists that condensation on parts of the device 34 could result in dripping on the web with the consequent damage thereto. In order to obviate such a possibility, I provide the device 34 with a heating system including an inlet line 98 connected to a suitable source of low pressure steam (not shown). The inlet pipe 98 leads to a distributor 100 which feeds a plurality of branch lines 102 respectively associated with the portions of the device 34 between adjacent stiffeners 60. Condensation from the branch pipes 102 flows into a drain line 104 which leads to a suitable disposal area.

It is to be noted that in the form of my suction transfer device illustrated in FIGS. 1 to 5, the respective exhaust pipes 68 and 70, together with extensions at the ends of the drain pipes 104, not only perform the functions described above, but also provide a means by which my transfer device is readily supported in operative position on the paper machine frame.

Preferably, I provide my vacuum transfer device 34 with means for automatically regulating the vacuum within the active side sections 38 and 40. Referring to FIG. 4, by way of example, I locate a pressure sensing device 106 of any suitable type known to the art within the section 38 above the bottom wall 56. The sensor 106 is adapted to put out an electrical or pneumatic signal which is the measure of the pressure within this section 38 above the bottom wall 56. I feed this signal to a suitable controller 108 which regulates the exhaust fan 72 to maintain the pressure at the desired value.

Figure 6:
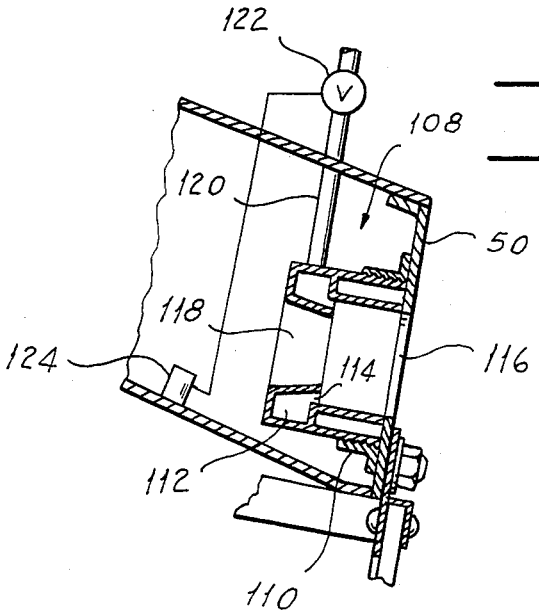
FIG. 6 is a fragmentary section illustrating an alternate form of my suction transfer device.

Referring now to FIG. 6 as an alternative to using the relatively cumbersome air exhaust system illustrated in FIGS. 1 to 5 of the drawings, I may employ an injection device indicated generally by a reference character 108. This device 108 may, for example, be screwed into a suitable fitting 110 mounted on the end wall 50 at the trailing end of each of the sections 38 and 40. The device 108 includes an annular chamber 112 having an annular output 114 opening toward an outlet opening 116 in the wall 50. Compressed air may be fed to the chamber 112 through a pipe 120 under the control of the valve 122. This compressed air passes outwardly through the openings 114 and 116. In so doing it draws air from within the section through the opening 118 surrounded by the annular chamber 112. The result is a slight negative pressure within the section 38 or 40. A sensor 124 may control the value 122 so as to produce the desired negative pressure.

It will be seen that I have accomplished the objects of my invention. I have provided a suction transfer device for use with a high speed paper dryer. My device is especially adapted for use in a machine employing a serpentine or unifelt dryer configuration. My transfer device is readily adapted to existing dryers.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a dryer in which the web to be dried is disposed outside of and below a length of the dryer fabric extending between two rolls in a dryer section having a single continuous fabric, apparatus including in combination a suction transfer device, and means mounting said device above said fabric length with said device extending from edge to edge of said fabric, means dividing said suction transfer device into side sections associated with the fabric edges and a central section between said side sections, said side sections including bottom plates adjacent to said fabric, said bottom plates being formed with undulations, said bottom plates being perforated in the regions of the crests of said undulations and unperforated in the regions of the troughs of said undulations, means for producing negative pressure in said side sections above said bottom plates, said center section comprising a central plate spaced above said fabric, respective seals with said fabric around the peripheries of said side sections, and a seal between the central plate at the entry end thereof and said fabric, said central plate diverging from said fabric in the direction of movement thereof to produce a slight negative pressure above said fabric in the area between said side sections.

2. A suction transfer device for a web comprising a pair of side sections and a center section, each of said side sections having a bottom wall undulating in a direction from the web entrance to said device to the web exit therefrom, said bottom walls being perforated in the regions of the crests and unperforated in the regions of the troughs of said undulations, respective seals around each of said bottom walls, a central plate between the side sections, and a seal at the entry end of the central plate, said central plate diverging from the bottom of the device in a direction from the entry end to the exit end.

3. In a dryer section in which the web to be dried is disposed outside of and below a length of the dryer fabric extending over a generally horizontal run from a take-off roll associated with the last roll of the press section to the first dryer cylinder of a dryer section having a single continuous fabric, apparatus including in combination, a generally horizontally disposed suction transfer device having a width substantially equal to that of said fabric and a length equal to the distance between a location adjacent to said take-off roll and a location adjacent to said cylinder, means mounting said suction transfer device in cooperative relationship with said dryer fabric over said distance whereby said device has an upstream end at which said fabric enters said device and a downstream end at which the fabric emerges from said device, said device comprising respective first and second seals extending along the length of said device from said upstream end to said downstream end, said seals being spaced inwardly from the edges of said fabric and in spaced relationship to each other to divide the device into a central section and a pair of side sections running along the edges of said fabric from said upstream end to said downstream end thereof, means including said first and second seals for forming seals with said fabric extending around the entire peripheries of each of said side sections, a third seal with said fabric extending across the upstream end of said central section, the downstream end of said central section being open, means for generating a slight negative pressure above said fabric throughout said central section, and means for producing negative pressure of a magnitude greater than said slight negative pressure throughout each of said side sections, each of said side sections including a perforated wall spaced from said fabric, said negative pressure producing means comprising means for producing a negative pressure above said walls, each of said perforated walls undulating in the direction of movement of said fabric, said perforations being located in the crest regions of said undulations with the through regions being unperforated.

* * * * *

UNITED STATES PATENT AND TRADEMARK OFFICE

CERTIFICATE OF CORRECTION

PATENT NO. : 4,757,619

DATED : July 19, 1988

INVENTOR(S) : Joseph A. Villalobos

It is certified that error appears in the above-identified patent and that said Letters Patent are hereby corrected as shown below:

In the Claims:

Claim 3, col. 6, line 52, "through"

should be --trough--.

Signed and Sealed this

Eighth Day of November, 1988

*Attest:*

*Attesting Officer*

DONALD J. QUIGG

*Commissioner of Patents and Trademarks*